United States Patent [19]

Marcus

[11] 4,178,626

[45] Dec. 11, 1979

[54] DRAWER LIGHT

[75] Inventor: Konrad H. Marcus, Holland, Mich.

[73] Assignee: Prince Corporation, Holland, Mich.

[21] Appl. No.: 896,986

[22] Filed: Apr. 17, 1978

[51] Int. Cl.[2] ..... F21V 33/00

[52] U.S. Cl. ..... 362/133; 362/155; 362/287

[58] Field of Search ..... 362/127, 133, 155, 203, 362/287

[56] References Cited

U.S. PATENT DOCUMENTS

| | | | |
|---|---|---|---|
| 1,532,935 | 4/1925 | Patton . | |
| 1,906,131 | 4/1933 | Baylis | 362/200 |
| 2,422,847 | 6/1947 | Peter | 362/133 |
| 2,431,491 | 11/1947 | Lee et al. . | |
| 2,456,867 | 12/1948 | Da Costa . | |
| 2,555,716 | 6/1951 | Todhunter . | |
| 2,765,396 | 10/1956 | Iverson | 362/203 |
| 3,519,812 | 7/1970 | Brindley et al. . | |
| 3,631,235 | 12/1971 | Odermann et al. | 362/133 |
| 4,071,747 | 1/1978 | Pantanella et al. | 362/127 |

*Primary Examiner*—Peter A. Nelson

*Attorney, Agent, or Firm*—Price, Heneveld, Huizenga & Cooper

[57] ABSTRACT

An illumination mechanism for a drawer or the like comprising a battery case containing batteries and a lamp bulb in a lamp bulb housing pivoted to the side of a battery case. The battery case is mounted proximate to a surface to be illuminated and circuitry within the battery case and in the lamp bulb housing energizes the lamp bulb when the lamp bulb housing is rotated to face the area to be illuminated, and deenergizes the lamp when the lamp bulb housing is rotated to a storage position.

8 Claims, 8 Drawing Figures

DRAWER LIGHT

This invention relates to an illumination mechanism and more particularly to a lamp for a drawer or the like.

Desk drawers, dresser drawers, file drawers and like areas are inaccessible to light, and contain little room for an illumination mechanism. The present battery operated closet lights and other portable lights are too large for small drawer areas, and do not combine an automatic switch mechanism with a means for protecting the lens of the light source when the drawer is closed.

It is an object of this invention to provide an illumination source for drawers and similar small areas inaccessible to the light.

Another object of the invention is to provide an illumination source which atuomatically energizes when the source is directed towards the area to be illuminated, and deenergizes when the illumination source is facing away from the area to be illuminated.

Still another object of the invention is to provide an illumination source which has its lens in a protected position when the illumination source is not in use while the drawer is closed, or being opened.

A battery case is provided which can be mounted easily and removably proximate to an area which it is desired to illuminate. The battery case has an end portion which may be removed to insert batteries, and a housing containing a lamp bulb that is pivotally attached to the other end of the battery case. A transparent lens is incorporated in the lamp bulb housing in front of the lamp bulb. Socket means holding the lamp bulb inside the housing combines with circuitry in the battery case to automatically energize the lamp bulb within the housing when the housing is rotated up to face the illuminated area. The same transparent lens is stored against the mounting surface by rotating the lamp bulb housing down when it is desired to again close the drawer.

These and other objects will become apparent from the following disclosure and the drawings in which.

Figure 1:
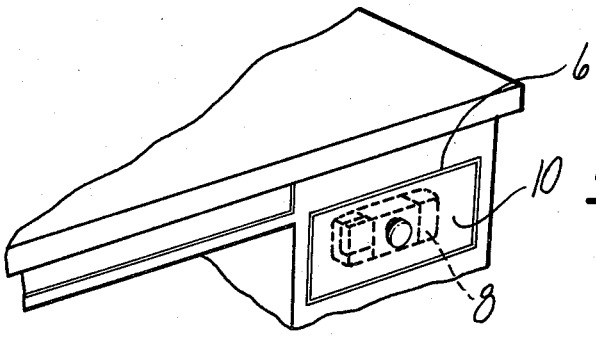
FIG. 1 is a perspective view showing the placement of an illuminating mechanism embodying the invention in a drawer.

Referring to the drawings, FIG. 1 shows an illumination mechanism embodying the invention generally designated at 8 and attached to a drawer face 10. The illumination mechanism 8 consists of a battery case 12 and a lamp housing 16 rotatable relative to the battery case 12. Circuitry within the battery case 12 and the lamp housing 16 energizes a lamp within the housing when it is rotated to an active position, and deenergizes the lamp when it is rotated in an inactive position.

Figure 2:
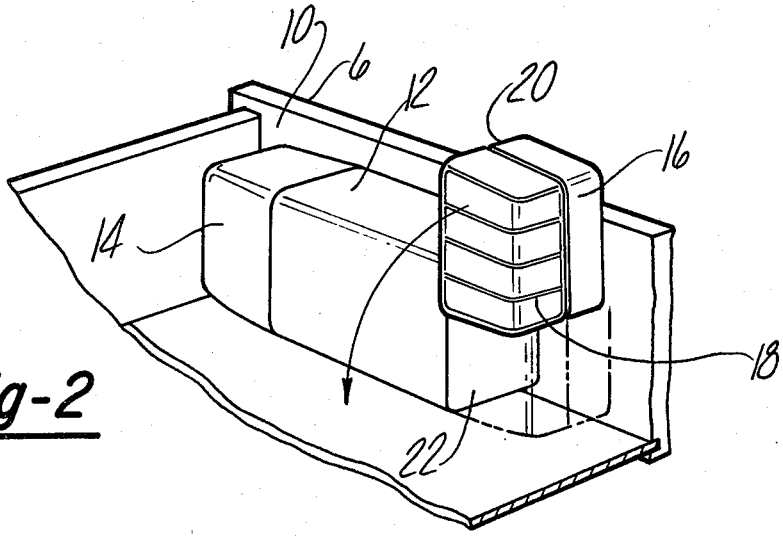
FIG. 2 is a perspective view of the illumination mechanism with a drawer open and the lamp bulb housing in an active position.
Figure 5:
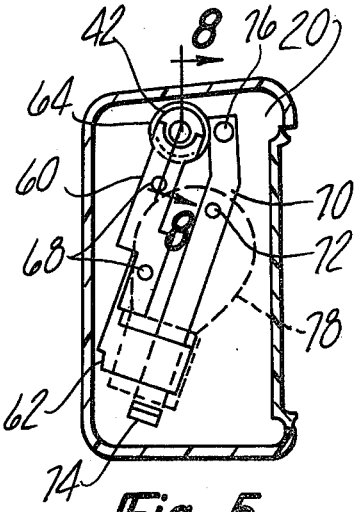
FIG. 5 is a cross-sectional view of the lamp bulb housing taken on line 5—5 in FIG. 3.

Referring to FIG. 2, the lamp housing 16 consists of a rectangular, hollow box like structure formed of plastic or some similar material with an open front. Attached to this open front by a snap fit is a transparent lens 18, also formed of plastic or a similar material. The attachment of lens 18 to lamp bulb housing 16 may be made by any means which allows easy removal of the lens 18 to give access to the lamp inside. A side wall member 20 of the lamp bulb housing 16, seen in FIG. 5, is of a dimension substantially equivalent to the dimension of adjacent side wall member 22 of the battery case 12. The two side wall members 20 and 22 are held in a proximate spaced apart relationship by a pivot mechanism shown in FIG. 8, which is described later.

Figure 3:
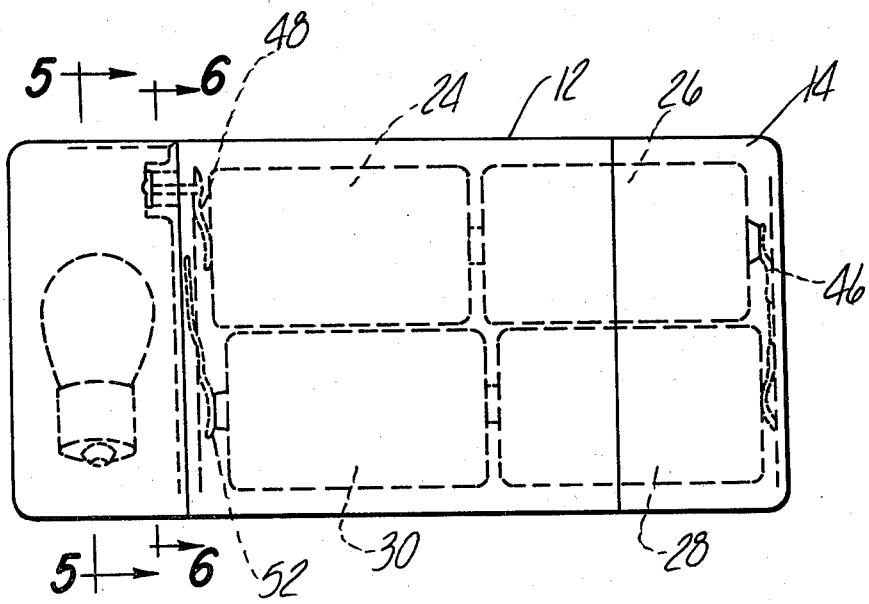
FIG. 3 is a rear view of the illumination mechanism with the lamp bulb housing rotated down and showing the placement of the batteries, lamp bulb and pivot mechanism.

Referring to FIG. 3, the battery case 12 is essentially a box of plastic or another similar material, with an inside dimension sufficient to hold the desired number of batteries. The number of batteries shown in four which are identified as 24, 26, 28 and 30. The battery case 12 contains an end cap 14 which is removable from the main body 12 by a snap fit, giving access to the batteries.

Figure 7:
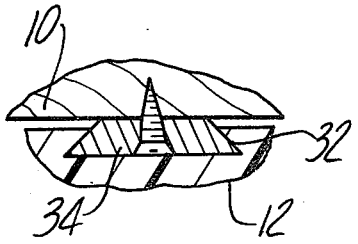
FIG. 7 is a view taken on line 7—7 in FIG. 4, showing the mounting means used to attach the illumination mechanism to a surface.

The mounting arrangement for the battery case 12 includes a dove tail slot 32, shown in FIG. 7, which is of an inside dimension equivalent to the outside dimension of a dove tail mounting bracket 34. A bracket 34 is mounted to the door face 10 by any suitable means. The bracket 34 is mounted in a position such that the lamp bulb housing 16 will be higher than the lip of the drawer face 10 when it is rotated upward.

Figure 8:
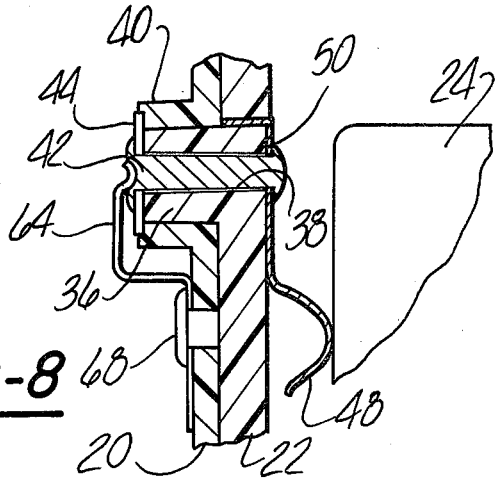
FIG. 8 is a view along line 8—8 in FIG. 5.

Referring to FIG. 8, the side wall member 22 of the battery case 12 is shown in a close, coplanar relationship to the side wall member 20 of the lamp bulb housing 16. Formed near the center and top of the side wall member 22 is a cylindrical projection 36 with a bore 38 through its center. Formed near the top and center of the side wall member 20 is a cylindrical journal 40 rotatably receiving the cylindrical projection 36. A rivet of conductive material 42 is fitted through the bore 38 with on of its heads against the side wall member 22 and its other head crimped over a washer 44 to hold it against the ends of the cylindrical projection 36 and cylindrical journal 40. This mechanism holds the two side walls members 20 and 22 in a close planar relationship, and thereby rotatably attaches the lamp bulb housing 16 to the battery case 12.

The circuitry and switching is illustrated in FIGS. 3, 5, 6 and 8. Referring to FIG. 3, a battery connector 46 of a conductive material is attached near its center to battery end cap 14, with one of its ends resiliently pressed against the positive terminal of battery 26 and its other end resiliently pressed against the negative terminal of battery 28. Referring to FIG. 8, a negative battery lead 48 is formed of a conductive material. One of its ends is resiliently pressed against the negative terminal of battery 24 and the other end has a hole 50 fitting over rivet 42 which holds the battery lead 48 against the side wall member 22. This attachment may be made by any means suitable to assure electrical conductivity between negative battery lead 48 and rivet 42.

FIG. 3 shows a positive battery lead 52 also formed of a conductive material which is resiliently pressed against the positive terminal of battery 30. The positive battery lead 52 passes through a slot 54 in side wall member 22, shown in FIG. 6, and comprises at its other end a spring switch member 56. The positive battery lead 42 and spring switch member 56, comprising a continuous piece of conductive material, are both attached to the side wall member 22 by spot welds or some other suitable attachment means, one of which is shown in FIG. 6 at 58.

The remainder of the circuitry is illustrated in FIG. 5. A negative bulb ground 60 is formed on a suitable conductive material and comprises at one of its ends a resilient cylindrical flange 62 and at its other end a yoke-shaped slotted end 64 which presses against the crimped end of rivet 42. The side view of this is visible in FIG. 8. This attachment provides for an electrically conductive connection between the end of the bulb ground 64 and the rivet 42, but allows the end of the bulb ground 64 to rotate relative to rivet 42. The bulb ground 60 is connected along its length to the side wall member 20 by spot welds or other suitable means shown at 68 in FIG. 5. A positive bulb lead 70 is formed of a conductive material, and is attached along its length to side wall member 20 by spot welds or other suitable conductive means, one of which is shown at 72. The lower end 74 of positive bulb lead 70 is bent outwardly and upwardly so that it rests beneath and near the center of the cylindrical flange 62 of the bulb ground 60. The opposite end of positive bulb lead 70 is attached to the side wall member 20 by a small rivet 76, which is of a conductive material and passes through side wall member 22 into the space between side wall member 22 and side wall member 20.

Also shown in FIG. 5, a lamp bulb 78 is held by its negative base in cylindrical flange 62 with the bent end 74 of the positive bulb lead 70 being resiliently pressed against its center positive post.

Figure 4:
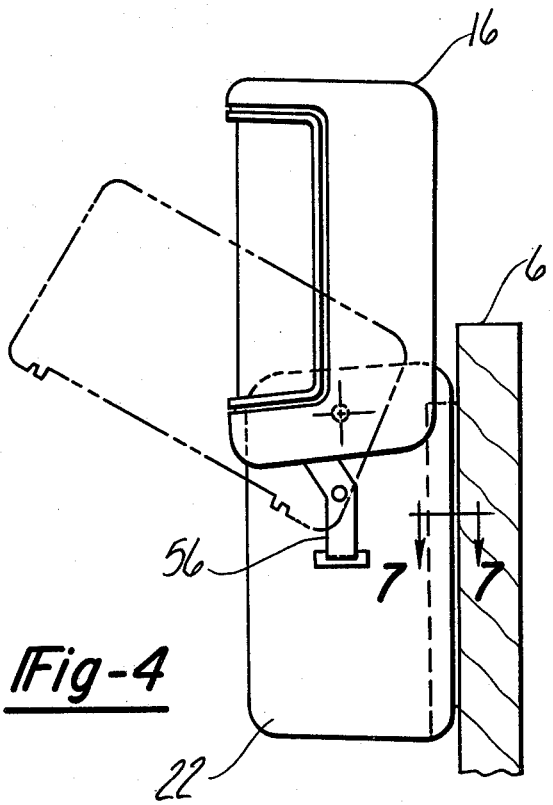
FIG. 4 is an end view of the illumination mechanism showing the path of rotation of the lamp bulb housing.
Figure 6:
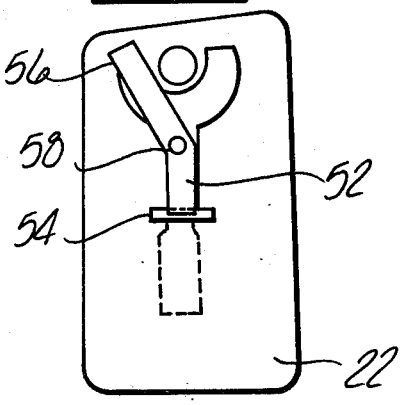
FIG. 6 is a view taken on line 6—6 in FIG. 3.

The rotation and illumination of the mechanism can be understood by reference to FIGS. 4, 5 and 6. FIG. 4 shows the lamp bulb housing 16 rotating relative to the side wall member 22 of the battery case 12, identified in FIGS. 4, 5 and 6. The spring switch 56 is held free in the space between the sidewall members 22 and 20. The end 76 of the positive bulb lead 70 which extends into the space between side walls 20 and 22 by means of the connection 76, is placed such that it is resiliently pressed against the end of spring switch 56 when the lamp bulb housing 16 is rotated up as shown in FIG. 4. Since there is a constant negative connection running from a negative terminal of battery 24 through negative bulb lead 48, through rivet 42, and through bulb ground 60, it will be seen that the circuit is completed when the bulb housing 16 is rotated up, and broken when it is rotated down. Thus the functions of raising the lamp above the area to be illuminated, energizing the lamp, and removing the lens from the position where it is stored, are all combined in the one step of rotating the lamp bulb housing up to the active position.

In summary, an illumination mechanism for a drawer has been provided which mounts inside the drawer with its lens protected against the drawer face in the off position, and which energizes and illuminates the drawer in the single step or rotating the lamp bulb housing up.

The embodiments of the invention in which an exclusive property or privilege is claimed are defined as follows:

1. An illumination mechanism for a drawer comprising in combination: a housing, means for mounting said housing to a support surface proximate to the area to be illuminated, a lamp assembly pivoted to said housing for rotation between an active position facing said area to be illuminated, and an inactive position facing said support surface, a source of power in said housing, and electrical circuit means between said source and said lamp assembly for energizing the latter when in said active position.

2. An illumination mechanism as described in claim 1, wherein said electrical circuit means further comprises switch means for energizing and deenergizing the lamp assembly.

3. An illumination mechanism as described in claim 2 wherein said switch means energizes said lamp assembly upon rotation to the active position and deenergizes said lamp assembly upon rotation to the inactive position.

4. An illumination mechanism as described in claim 1 wherein said lamp assembly is pivoted relative to said housing about a horizontal axis.

5. An illumination mechanism as described in claim 2 wherein said battery case further includes a substantially planar sidewall member substantially perpendicular to the mounting surface, and said lamp assembly is pivoted to said sidewall member.

6. An illumination as described in claim 4 wherein said lamp assembly comprises a lamp bulb housing, said lamp bulb housing contains socket means holding a lamp bulb, said lamp bulb housing further including a trasnparent lens held in front of said lamp bulb.

7. The combination of claim 1 wherein said lamp assembly is pivoted about a pivot member, said pivot member being electrically conductive and being connected to said lamp and to said source, a first contact element on said lamp housing being connected to said lamp, a second contact on said housing being connected to said source, said first and second contacts being movable into engagement with each other when said lamp assembly is moved to an active position and being movable out of engagement with each other when said lamp assembly is moved to an inactive position.

8. The combination of claim 4 wherein the active position of said lamp assembly is disposed above said horizontal axis in an elevated position above the area to be illuminated.

* * * * *